US007044714B2

(12) United States Patent
Bevan et al.

(10) Patent No.: US 7,044,714 B2
(45) Date of Patent: May 16, 2006

(54) SYSTEM AND METHOD FOR CONTROLLING PUMPING OF NON-HOMOGENOUS FLUIDS

(75) Inventors: Stuart F. Bevan, Glencoe (CA); Timothy Lownie, London (CA)

(73) Assignee: 1273941 Ontario Inc., Glencoe (CA)

( * ) Notice: Subject to any disclaimer, the term of this patent is extended or adjusted under 35 U.S.C. 154(b) by 0 days.

(21) Appl. No.: 10/855,773

(22) Filed: May 28, 2004

(65) Prior Publication Data

US 2005/0013697 A1 Jan. 20, 2005

Related U.S. Application Data

(63) Continuation of application No. 09/409,990, filed on Sep. 30, 1999, which is a continuation of application No. 08/848,829, filed on May 5, 1997, now Pat. No. 5,984,641.

(51) Int. Cl.
*F04B 49/10* (2006.01)

(52) U.S. Cl. ..... 417/12; 417/22; 417/32; 73/204.11; 73/204.15

(58) Field of Classification Search ..... 417/12, 417/32, 42, 43, 22; 73/204.11, 204.15
See application file for complete search history.

(56) References Cited

U.S. PATENT DOCUMENTS 5,984,641 A * 11/1999 Bevan et al. ..... 417/32

* cited by examiner

*Primary Examiner*—Charles Freay
(74) *Attorney, Agent, or Firm*—Kevin Pillay; Gowling Lafleur Henderson LLP

(57) ABSTRACT

A controller for controlling the pump unit of an oil well includes a sensor having a first and second probe for placement in the flow of oil from the well bore. Each of the probes contains a heater. A constant power source is selectively connected to one of the heaters. Each of the probes also include a linear RTD at each of their tips respectively for generating a signal indicative of the temperature measured at each of the first and second probes. A control unit receives signals from the RTD's and determines a flow rate therefrom. A pump control signal is generated in response to the flow rate, wherein pump control signal continuously varies a predetermined parameter of a pumping unit during operation of the pumping unit.

18 Claims, 7 Drawing Sheets

SYSTEM AND METHOD FOR CONTROLLING PUMPING OF NON-HOMOGENOUS FLUIDS

This application is a Continuation Application from U.S. application Ser. No. 09/409,990 filed Sept. 30, 1999 which in turn is a Continuation Application from U.S. patent application No. 08/848,829, filed May 5, 1997, now U.S. Pat. No. 5,984,641.

The present invention relates to a controller for pumps used in oil wells and a method for controlling a pump operation.

BACKGROUND OF THE INVENTION

In recovery of oil from oil wells, pumps are used to draw crude oil from the well bore to the surface well head. The crude oil extracted generally consists of a combination of oil, natural gas, grit, wax and water. The pumps generally comprise two types, namely, continuous flow or on-off pumps, and are powered by either electrical or natural gas motors. Upon emerging at the well head, the crude oil is passed via a pipe to separation tanks where the oil is removed from the mixture extracted from the well bore. The oil may also be temporarily stored in the separation tanks.

The maximum obtainable production rate for a well depends on the rate of migration of crude oil from its geological formation to the well bore. The well bore is unique in having both an inflow and an outflow. The inflow represents the quantity of crude oil that a local formation can deliver to the well bore, whereas the outflow (or rate capacity) represents the quantity of crude oil that can be delivered to the surface (or well head). Typically, the quantity of oil that a pump is able to extract from a well bore (or rate capacity) exceeds the rate of flow of the crude oil from the local formation into the well bore. This situation in normally exacerbated with age of the well. Also, the actual flow rate of crude oil into the well bore can deviate significantly at any particular point in time from an average flow rate for that well.

Thus, it may be seen that if the rate capacity of a pump exceeds the rate capacity of the well, the pump is then operating below maximum efficiency. As the cost of operating the pump is relatively high, this reduced efficiency translates into a wasted cost. Furthermore, sever pump degradation may be caused by having a pump operate above the well production rate. Conversely, if the pump rate falls below the wells production rate, oil accumulates in the well bore resulting in an equilibrium established between oil flowing into the well bore from the formation and causing a resultant drop in production. Furthermore, for progressive cavity type pumps or continuous flow pumps, it is necessary to always maintain fluid in the well bore. Thus, control of the pump rate is relatively more critical in this case.

Thus, there exist the need for a method and apparatus to control pump rates in response to changing rates of oil flow. There have been many attempts in the prior art to mitigate some of these problems, and in particular, the reader is referred to the applicant's U.S. Pat. No. 5,525,040 which describes prior art attempts.

SUMMARY OF THE INVENTION

This invention seeks to provide an oil pump controller which may be utilized to control various types of oil pumps in differing environments.

A controller for controlling the pump unit of an oil well comprising:

a) a sensor having a first and second probe for placement in the flow of oil from the well bore;

b) power generation means for generating a substantially constant power;

c) a first heater in said first probe adapted to be connected to said power generation means;

d) temperature-sensing means at each of said first and second tips respectively for generating a signal indicative of the temperature measured at each said first and second probes;

e) control means for receiving said signals from said temperature sensing means and determining a flow rate therefrom and generating a pump control signal in response to said flow rate, said pump control signal for continuously varying a predetermined parameter of the pump unit during operation of the pump unit.

A further aspect of the invention provides for the predetermined parameter being the pump speed.

A still further aspect of the invention provides for a processor means including a) means for determining a temperature difference between said first and second temperature sensing means said temperature difference being indicative of a flow rate in said well;

b) means for generating said output signal being indicative of a pump speed;

c) means for storing a table of flowrates versus said predetermined pump speeds;

d) means for determining a rolling average of said flowrates;

e) means for comparing said current rolling flow average to a stored flowrate and either incrementing said pump speed if said stored flowrate exceeds said average, or decrementing said pump speed if said flowrate is less than said average;

f) means for updating said table.

A further aspect of the invention provides for the temperature-sensing means to be a linear RTD

BRIEF DESCRIPTION OF THE DRAWINGS

A better understanding of the invention will be obtained by reference to the detailed description below in conjunction with the following drawings in which:

FIG. 6(*b*) is a detailed flow chart of the set-speed step of FIG. 6(*a*)

DETAILED DESCRIPTION OF PREFERRED EMBODIMENTS

Figure 1:
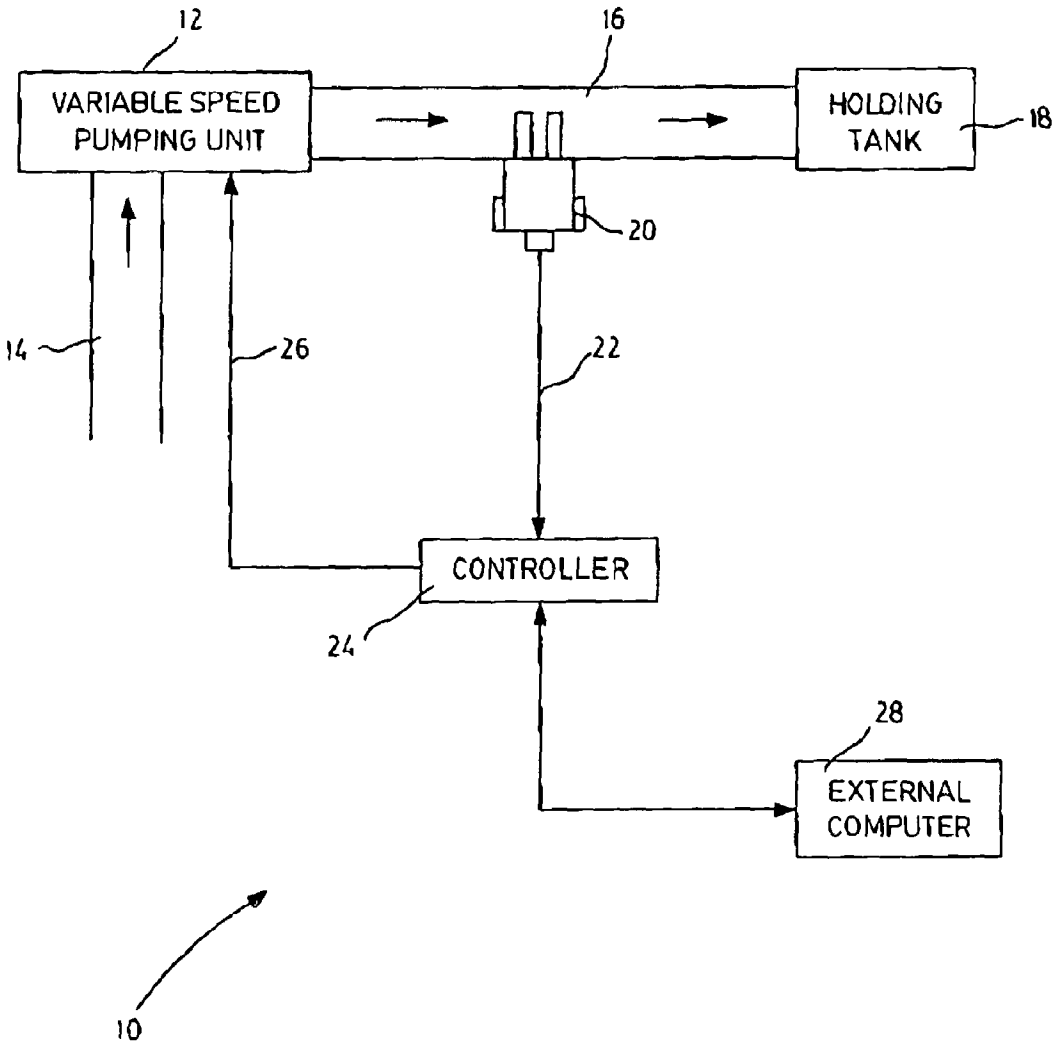
FIG. 1 is a block diagram of a controller according to the present invention.

Referring to FIG. 1, a block diagram of a pump controller is shown generally by numeral 10. A variable speed pumping unit 12 extracts crude oil from a well bore 14, which is then pumped via a conduit 16 to a holding tank 18, or the like. The pump control system includes a sensor 20 which is placed in the path of the oil flow in the conduit 16, in a manner to be described below. The sensor 20 provides an electrical signal indicative of flow via a cable 22 to a main control unit 24. The control unit 24 provides a control signal 26 to control the variable speed pump unit 12. The control signal 26 maintains the pump speed at an optimal level in order to ensure efficient extraction of crude oil from the well bore 14. An external computer 28 may be connected to the controller unit 24 in order to download or control parameters of the controller. Furthermore, the computer 28 includes a graphical display system for displaying information on the controller performance. Each of these elements will be discussed in detail below.

Figure 2:
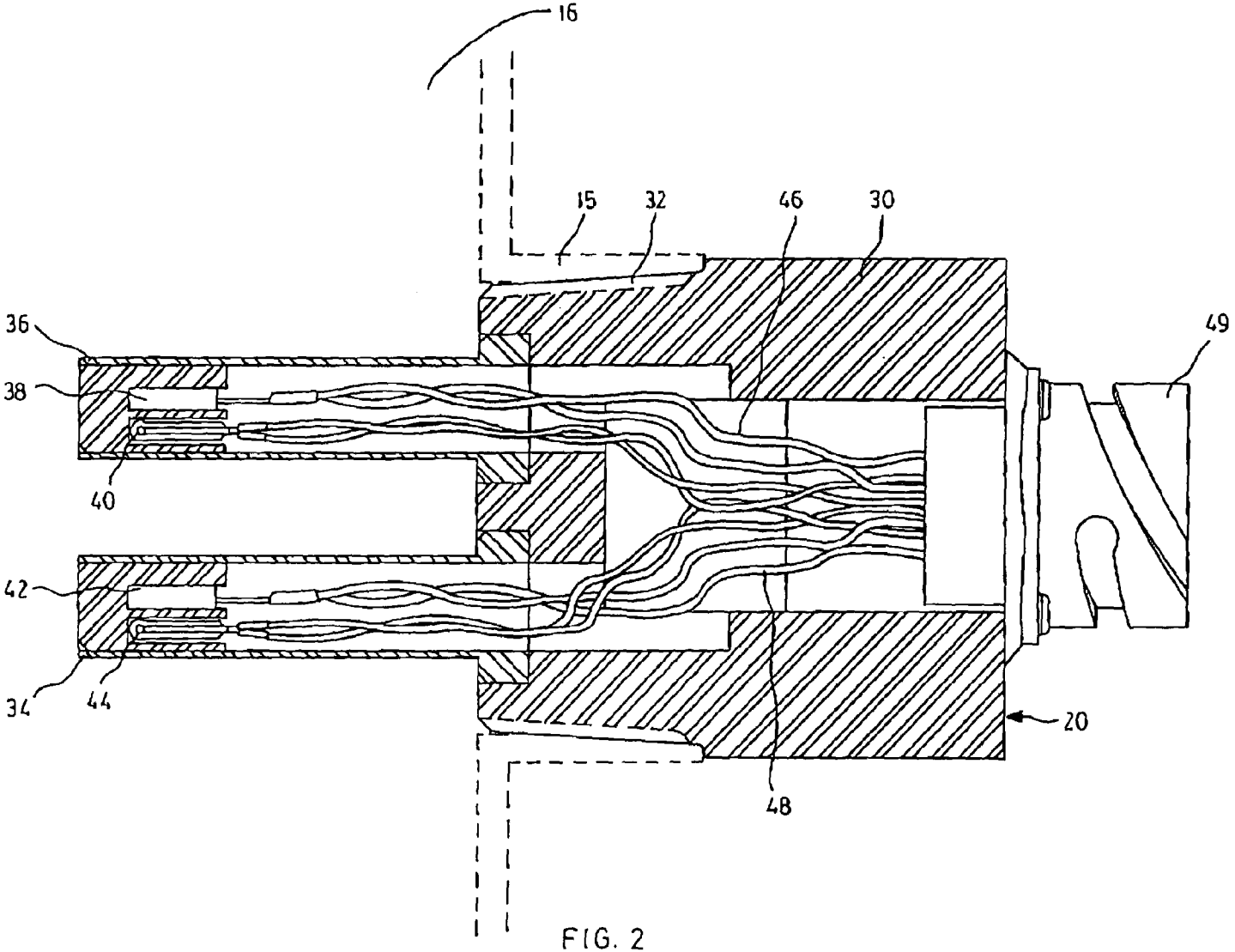
FIG. 2 is a cross-sectional view of a probe according to the present invention.

Referring to FIG. 2, a cross-section of the sensor 20 in FIG. 1, is shown. The sensor 20 is a passive device in that it must be powered from the controller 24. The sensor includes a cylindrical body section 30 and a lower threaded section 32 for installing in a bore of a T-pipe section 15 in the conduit 16. Generally, the sensor is installed relatively close to the well head. A pair of probes 34 and 36 project from one end of the body 30 so that when the sensor is inserted into the conduit 16, oil can flow over each of the probes uniformly. The actual orientation of the probes within the conduit is not critical, however, the probes should project generally perpendicularly to the direction of flow in the conduit. The probes 34 and 36 are each comprised of a hollow polished stainless steel tube and each contain a heating element 38, 42 and a temperature sensing element 40,44, respectively. A heating current derived from the controller 24 is provided to the heating element 38 and 42 via a suitable electrical conductor 46 and temperature measurement signals are returned from the temperature sensing elements to the controller via a pair of conductors 48. The conductor 46 and 48 are attached to a connector 49 which may be attached to cable 22.

The sensor operates on a thermal dispersion principle based on Newton's law of cooling. One of the probes is selected and its heating element is supplied with a constant energy, which radiates out as heat. We generally refer to this probe as the energized probe. Its counterpart probe or unheated probe is generally called the ambient probe. Both the probes provide a temperature signal from their respective temperature sensing elements. Thus, it may be shown that the heat input rate into a medium may be expressed by the equation $Q=h\Delta t$, where h is the convection heat transfer co-efficient and $\Delta t$ is the temperature difference between the heat source and the medium. In this case, $\Delta t$ is the temperature difference between the heated and ambient probes. The value h is a function of the flow rate of the medium. Hence, h is not constant. Thus it may be seen that the temperature differential between the probes is inversely proportional to the flow rate of the medium for a given heat input rate Q.

It may be more accurately stated that the velocity of the fluid is a function of the inverse of the square of the difference in temperatures between the two probes. By heating one of the probe tips at a constant rate, the difference in temperature between the probe tips provides a relative temperature measurement independent of the ambient temperature of the fluid.

The calculated velocity of the fluid is proportional to the square of the energy transfer into the probe. Therefore, it is important that the energy supplied to the probe is stable over a wide range of ambient conditions. Furthermore, in situations were high flow exist, most of the radiated heat is absorbed by the passing fluid and carried down stream. The temperature thus recorded at either of the energized or ambient probe is approximately the same. However, with reduced fluid movement across the probes, residual heat builds up along the tip of the energized probe thus resulting in a higher temperature measurement relative to the ambient probe. By comparing the energized probe temperature to the ambient probe temperature, the flow rate can be estimated to produce a value which is substantially independent of the temperature of the oil flowing past the probe. Additional compensation for the variation of constant fluid properties from well to well with temperature is implemented in the controller 24.

Figure 3:
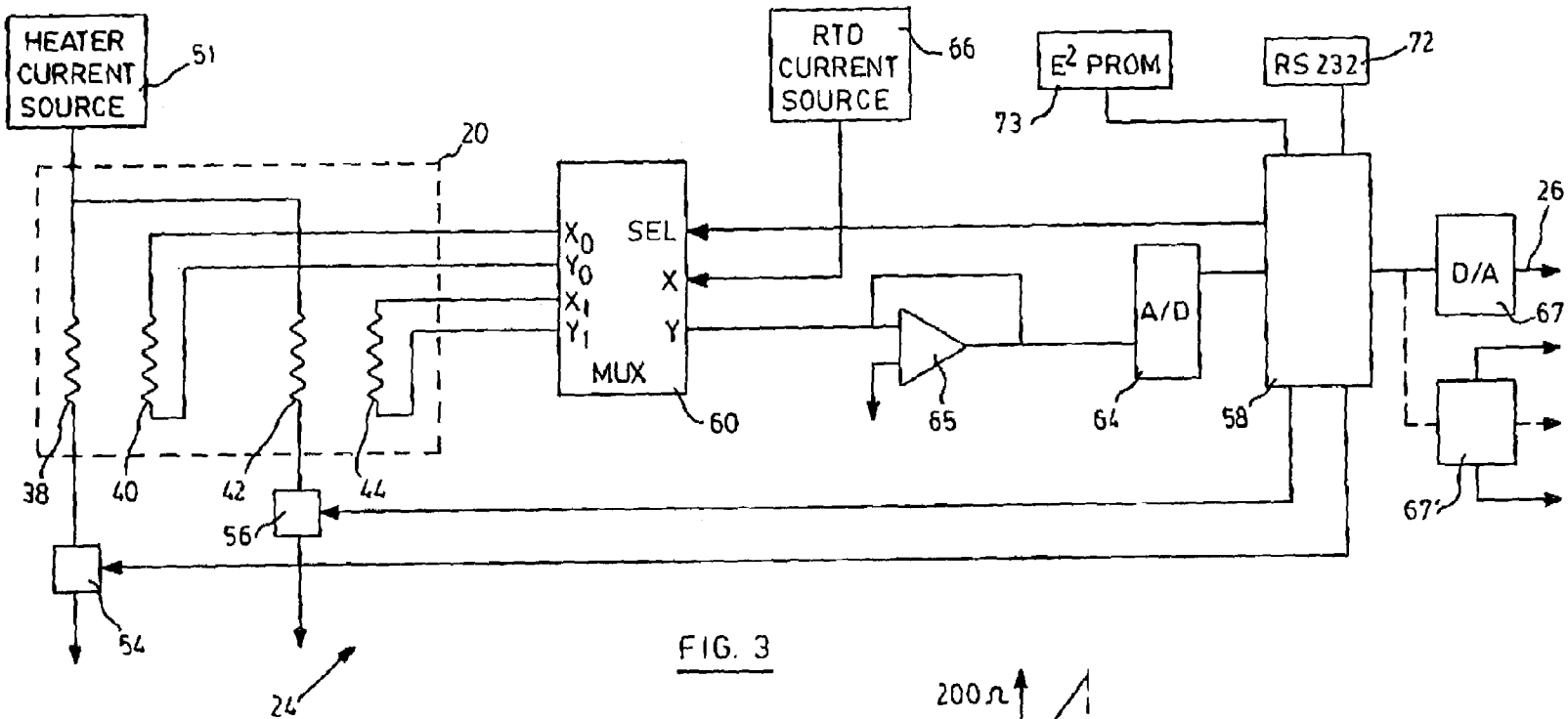
FIG. 3 is a schematic diagram of the controller unit shown in FIG. 1.

Referring now to FIG. 3, the controller 24 is shown in greater detail. The sensor electronics is shown schematically by block 20. The controller 24, includes a heater constant current source supply 51 which provides a constant current to the heater elements 38 and 42 located in the sensor 20. Each of the heater elements 38 and 42 are connected to a respective switch 54 and 56. These switches 54 and 56 are selectively controlled via a microcontroller 58 for selecting either one of the heater elements 38 or 42 to be heated.

Figure 4:
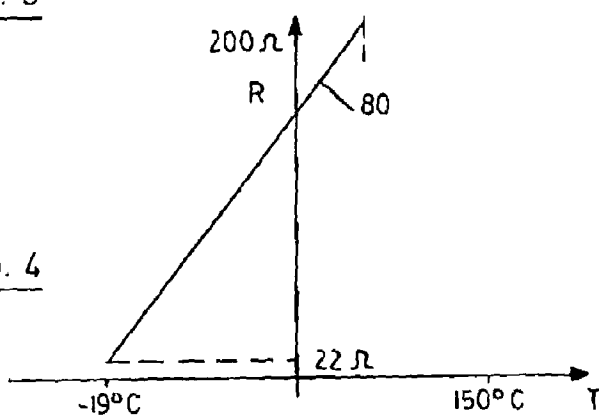
FIG. 4 is a diagram of an RTD response curve.

As described earlier, each of the heater elements has in close proximity thereto a temperature sensing element 40 and 44. The temperature sensors in this case are platinum RTDs (resistance-to-temperature devices). As may be seen in FIG. 3, each of the RTDs 40 and 44 have one of their inputs 59 connected via a switching multiplexer 60 to an RTD constant current source 66. The output of the temperature sensor resistors 40 and 44 are connected via the multiplexer 60 to the analog input of an analog-to digital converter 64 through a buffer amplifier 65. The analog-to-digital converter 64 provides a digital input to the micro-controller 58 which is indicative of the temperature measured by a respective RTD 40 or 44. As seen in FIG. 4, the RTD devices are linear devices and are capable of exhibiting a linear resistance change over an approximate temperature range of −19° C. to 150° C. The micro-controller 58 then processes this input data described with reference to FIGS. 6(*a*), 6(*b*) and FIG. 7. A digital-to-analog converter 67 has its digital inputs driven by an output of the micro-controller 58 to produce an output analog signal indicative of a speed control signal 26 for control of the pumping unit 12 shown in FIG. 1.

In addition, an RS232 interface and driver support circuitry 72 is provided for communication with the micro-controller 58 by the external computer 28. Additional $E^2$ PROM 73 is provided for storage of constants and additional parameters.

Referring to FIG. 4, a resistance-to-temperature graph 74 illustrating the relationship between the resistance and temperature of the RTD is shown generally by numeral 80. It may be seen that the relationship is relatively linear over a large temperature range. This has the advantage in that over a period of time, the temperature of the resistor may be sampled by the analog-to-digital converter 64 and an integer interpolation routine may be used to determine values of resistance between the sampled points. Thus, it is not required that a large amount of memory be utilized in the micro-controller in order to store a lookup table, as for example, when a non-linear thermistor is used as temperature sensing element.

By providing heating elements in each of the probes of the sensor 20, allows for each of the probes to be periodically made the energized probe. In the case of oil wells with high paraffin wax content, if only one of the probes is heated, then over a long period of time, wax would tend to accumulate on the unheated probe. This would result in skewed temperature readings. However, by providing heaters in both probes and providing a means for switching between the heaters in the probes reduces wax build up on the probes. Furthermore, the lifespan of the sensor is extended by switching the heating elements between the probes since constant heating of only one of the probes results in sever degradation of the lifespan of that probe.

Figure 5:
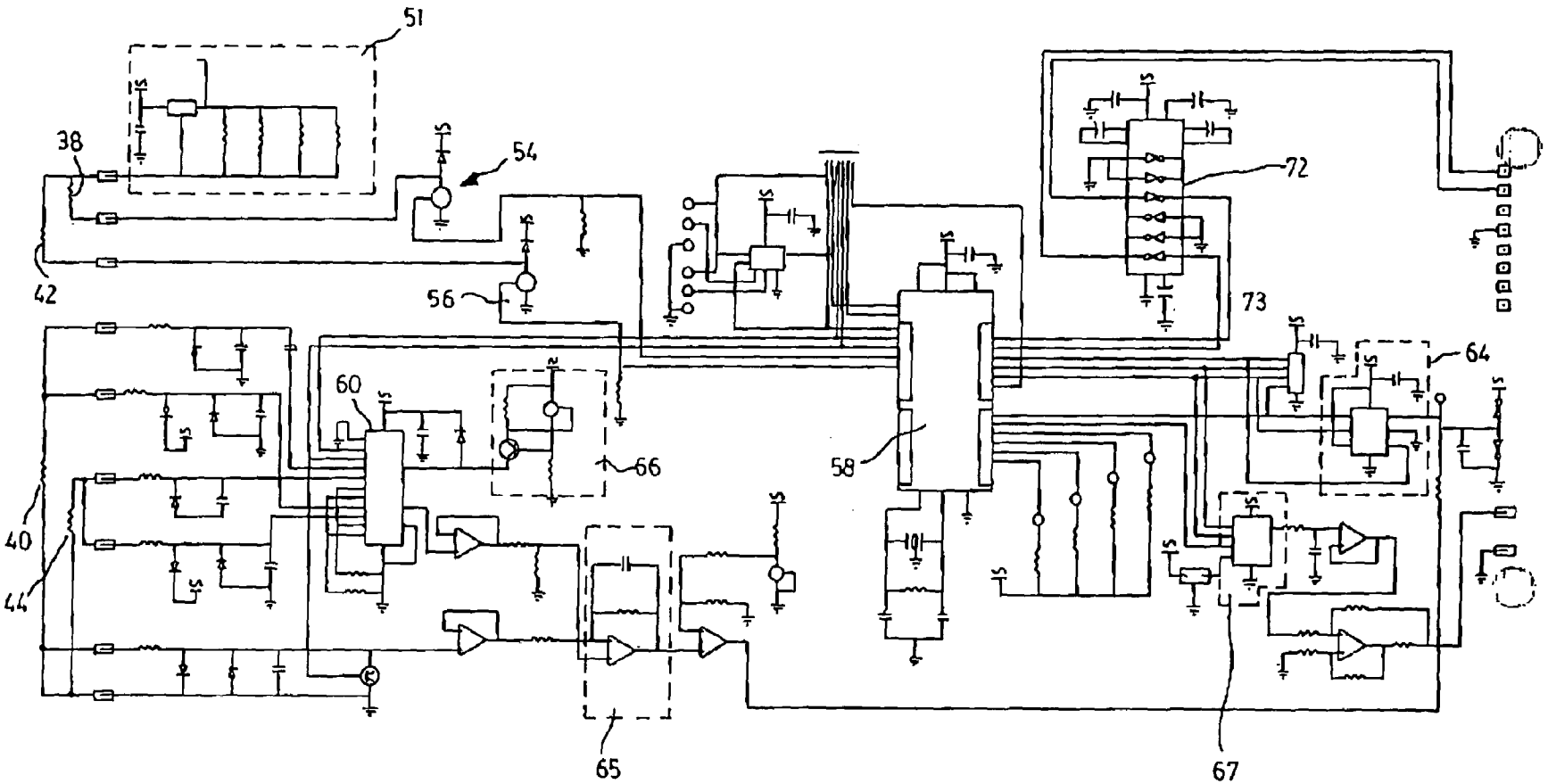
FIG. 5 is detailed circuit diagram of the controller unit of FIG. 3.

FIG. 5 is a detailed circuit diagram of the controller 24, wherein the micro-controller is a type 68HC705.

Figure 6A:
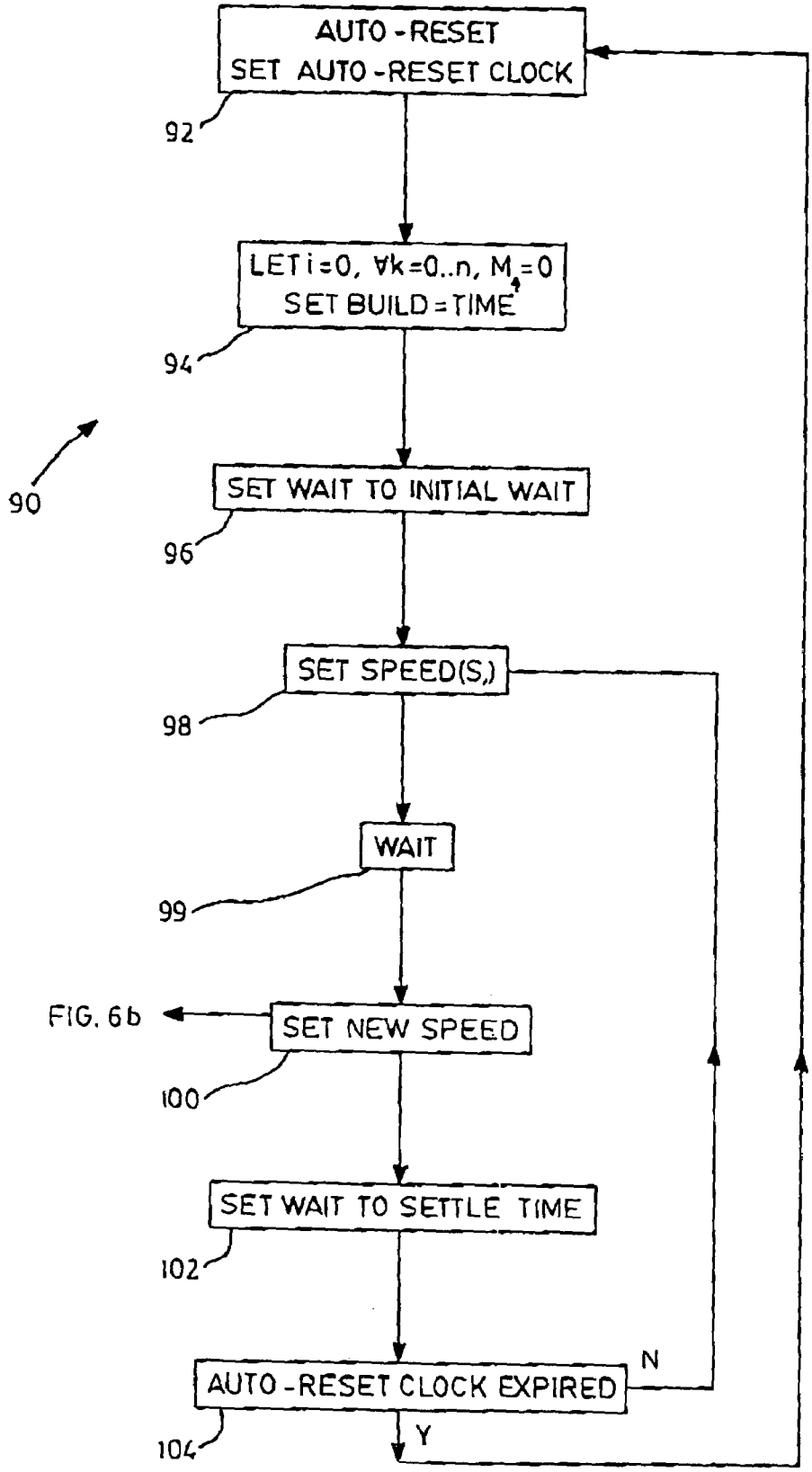
FIG. 6(*a*) is a flow chart of a variable speed control algorithm.
Figure 6B:
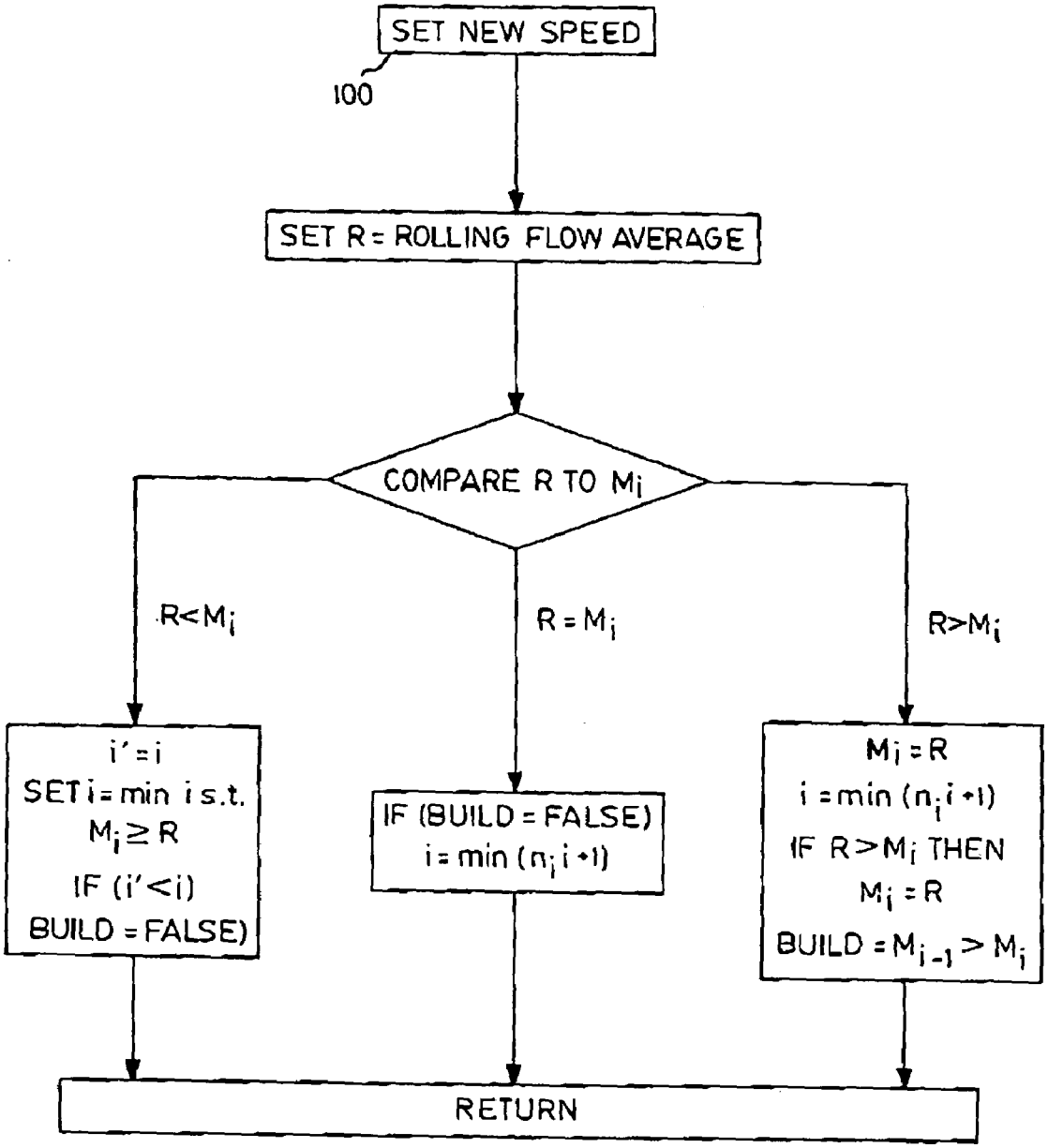

Referring now to FIGS. 6*a* and 6*b*, an algorithm implemented by the micro-controller 58 for controlling the output signal 26 to the pump, is indicated generally by numeral 90. The micro-controller switches the constant power source 57 to one of the heaters 30 or 42 by activating one of the switches 54 or 56. The micro-controller then obtains a first $T_1$ and second $T_2$ digitalized temperature measurement from the input signal received from the analog-to-digital converter 64 by sending a signal to the multiplexer 60 to select in sequence the temperature probe 40 or 44. The difference between these temperatures $\Delta T$ is calculated and is indicative of a flow measurement. These flow measurements or temperature differentials are combined into an average of most recent samples called a rolling flow average. The micro-controller samples the temperature approximately once ever second. The controller stores a sixteen element rolling window of samples. Once sixteen samples have been included in a rolling window, the newest sample replaces the older sample prior to the latest average being calculated. That is, a rolling average is calculated over a sample of sixteen elements every second with each element being discarded after 16 seconds. The process of obtaining flow measurements is continuous and proceeds in parallel with other processing by the micro-controller.

Once this flow is obtained by the micro-controller, the oil flow at the well head is controlled in accordance with the sequence of steps illustrated in FIGS. 6(*a*) and 6(*b*). Initially, an auto reset clock 92 is set to count time down from 48 hours or any other convenient time. This clock serves to reset the parameters of the controller in order to accommodate drops in motor efficiency over time and to switch the heated probe.

The microcontroller maintains a speed table of entries having rows of measured flow rates $M_i$ and pump speed $S_i$. Thus, at a step 94, this table is initialized. An initial wait time is then set at step 96. This period is initially set between 8 to 12 minutes.

It may be noted that for variable speed control applications, the digital-to-analog converter delivers 4 to 20 milliamps output signal. By convention, 4 milliamps represents the lowest speed setting $S_0$ of the pump, while 20 milliamps represents the highest speed $S_n$ setting of the pump. An increment or step in speed is generally designated as 1 milliamp representing the least step up or step down for change in speed.

In implementing the variable speed control, it is assumed that each increase in speed corresponds to some increase in the maximum potential delivery rate of the pump. Thus it is the goal to operate the pump at the lowest speed with the delivery rate above the current production rate measured for the well. Thus, in order to achieve this, the speed table, as described earlier, keeps track by way of the rolling flow average of the maximum delivery rate obtained thus far for each selected speed of the pump.

Changes in speed occur on the basis of time intervals. The length of each interval is called the settled time $T_s$. Its purpose is to allow changes in the pump speed and the well's production rate to be reflected in the rolling flow average. By default, the length of the settle time is 2 minutes. At the end of each interval, depending on whether the rolling average has increased, decreased or stayed the same, a corresponding change in speed is initiated. These changes in speed may be made as a single increment or as an arbitrary number of increments per interval.

Thus, referring back to step 98 in FIG. 6, an initial speed $S_i$ of the pump is set. The controller waits a predetermined time at step 99. A new speed is then set at step 100 according to the algorithm of FIG. 6(*b*). The table is initially built from the lowest speed $S_0$ upward, first, the speed is set to $S_0$ and an initial flow $M_0$ is obtained for speed $S_0$. The speed is then stepped up to $S_1$ and a corresponding flow $M_1$ is obtained. This is repeated for successive values of speed increments. It is assumed, however, that each step between a speed $S_1$ and a speed $S_{i-1}$ corresponds to a corresponding step in the maximum potential flow rate. Therefore, if upon obtaining $M_{i+1}$ at speed $S_{i+1}$, it is recognized that $M_{i+1} \leqq M_i$, then it is clear that the well's current production rate is below what the pump can deliver at speed $S_{i+1}$. For example, if $M_{i+1}$ is equal to $M_i$, it indicates that the well at this time is producing at a constant rate which corresponds to a speed $S_i$. Otherwise, if $M_{i+1}$ is less than $M_i$, it indicates that during the settle interval at $S_{i+1}$, production from the well has decreased. In this case, $S_i$ may represent a greater speed than is required to support the lowered production rate. Therefore, a search of the table is performed beginning at $S_i$ down to $S_0$ until the lowest speed having a maximum delivery rate above the current production rate is found.

It may therefore be seen that building the speed control table occurs in conjunction with varying the pump speed. When production levels or flow rates from the well increase, the table is refined while the speed is increased. Conversely, when lower flow rates are measured from the well, the table is searched for the minimum speed required to sustain that flow rate.

To illustrate how the process of building a table is performed after a drop in flow rate is detected, let $S_p$ represent the last speed prior to detecting a drop in flow rate, and let $S_i$ be the current speed. For example, $S_p$ might be 12 mA and $S_i$ might be 9 mA. As flow rate from the well increases, the production rate at speed $S_i$ as measured by the rolling flow average will begin to approach $M_i$, which is the estimated maximum flow rate at $S_i$. At the end of an interval, if the production rate is found to be closer to $M_i$, then the speed is incremented up to $S_{i+1}$. Assuming production levels continue to improve, the speed is successively increment up to $S_p$. As this point, the table is continued to be built until either flow rate decreases or the maximum speed $S_n$ is reached.

Alternatively, if at the end of the interval at speed $S_i$, the production rate may be greater than $M_i$. In this case, $M_i$ is no longer the best estimate to the maximum flow rate at $S_i$. The new flow rate is then substituted for the old value of $M_i$. The change to $M_i$ can also impact $M_{i+1}$, if the new value for $M_i$ is also greater than $M_{i+1}$. Therefore, the table is rebuilt for $S_{i+1}$. Thus, it may be seen that changes can precipitate through entries in the table thus allowing the controller to constantly fine tune its estimates based on better information over time. This is illustrated more clearly in FIG. 6(*b*). Once the new speed $S_i$ is set at step 100, a new settle time is set at step 102.

Besides the settled time, there are two other timing intervals involved in variable speed control. These are the initial wait and automatic reset time. The initial wait time is simply the settling time for the very first interval in building the table. As such, it only occurs once just after the instrument is reset or powered on. The initial wait is typically longer than the settled time.

The automatic reset time is not directly related to variable speed control. Instead, it is simply a background timer which upon time out at step 104 initiates an automatic reset of the controller. This causes the speed table to be rebuilt. The automatic rest serves several purposes as described earlier.

Figure 7:
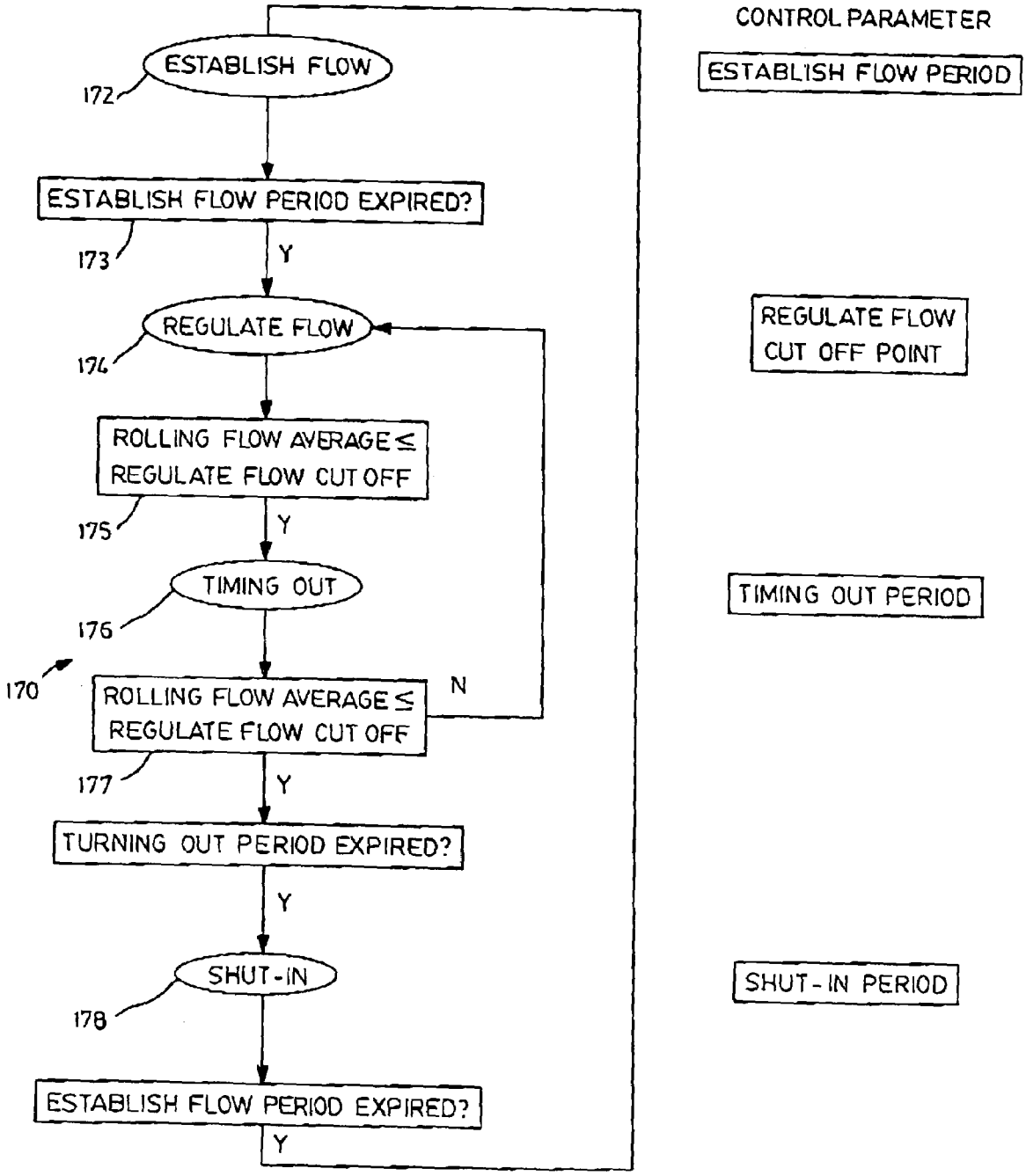
FIG. 7 is a flow chart of an on-off speed control algorithm.

Referring now to FIG. 7, a process flow for controlling an on/off type pump is shown generally by numeral 170. In this case, the micro-controller 58 may send a signal to the digital-to-analog converter 67 one of two signals, namely, a value corresponding to a pump-off signal or a value corresponding to a pump-on signal. Alternatively, a relay 67 may be provided which turns the pump 12 on or off. The process is divided into four steps, namely, establish flow 172, regulate flow 174, timing-out 176 and shut-in 178. It is to be noted that each step is associated with a single control parameter which directs the process of that step. A default setting is assigned to each control parameter. However, these parameters may be easily changed via the external computer 20. The parameters associated with these steps are establish flow period, regulate flow cutoff point, timing-out period and shut-in period. Generally, these parameters are set at a default value of 15 minutes, 25%, 1 minute and 30 minutes, respectively.

The establish flow step 172 starts the pump and settles into an interval of time called the establish flow period 173. This establish flow period is indicative of a flow of the current state of the well. For example, this interval generally covers the time required for oil to make its way to the surface and past the probes. Although flow samples are obtained by the controller during this period, output signals to control the pump are not provided during the establish flow period. Once the establish flow period has expired at step 173, the process moves onto the regulate flow step 174.

In the regulate flow period 174, an ongoing flow sample is combined into a rolling average called the rolling flow average as described earlier. However in this case, a rolling flow average is compared against a regulated flow cutoff point 175. If the rolling flow average remains above the cutoff point, a process control cycle remains at this step. However, should the rolling flow average drop below the regulated flow cutoff point, this signals a pumpoff has occurred and the process moves on to the timing-out step 176.

In the time out step 176, a short period called the time out period is provided to confirm whether or not the well has actually pumped off. This avoids instances where trapped gas pockets are within the line or short segments of dry pumping have occurred. During timing out, the ongoing rolling flow average continues to be compared against the regulated flow cutoff point 177. If the rolling average moves back above the cutoff point before timing out period expires, then the process moves back to the regulate flow step 174. Otherwise, at the end of the timing out period, the process moves to the next step which is the shut-in step 178.

In the shut-in step 178, the pump is stopped and the well enters an idle state allowing time for the well bore to be refilled from the surrounding formation. The length of time the well remains idle is determined by the shut in period. Once the shut in period expires, the process control begins at the establish flow step 172.

While the invention has been described in connection with a specific embodiment thereof and in a specific use, various modifications thereof will occur to those skilled in the art without departing from the spirit of the invention as set out in the claims.

The terms and expressions which have been employed in the specification are used as terms of description and not of limitations, there is no intention in the use of such terms and expressions to exclude any equivalents of the features shown and described or portions thereof, but it is recognized that various modifications are possible within the scope of the invention as set out in the claims.

The invention claimed is:

1. A controller for controlling a pump unit of an oil well comprising:

a) a sensor having a first and second probe for placement in the flow of oil from the well bore;

b) power generation means for generating a substantially constant power;

c) a first heater in said first probe adapted to be connected to said power generation means;

d) temperature-sensing means at each of said first and second tips respectively for generating a signal indicative of the temperature measured at each said first and second probes;

e) control means for receiving said signals from said temperature sensing means and determining a flow rate therefrom and generating a pump control signal in response to said flow rate, said pump control signal for continuously varying a predetermined parameter of a pumping unit during operation of said pumping unit.

2. A controller as claimed in claim 1, said predetermined parameter being said pump speed.

3. A controller as claimed in claim 1, said first heater being a resistor.

4. A controller as claimed in claim 3, said power generation means being a first constant current power source.

5. A controller as claimed in claim 1, said temperature-sensing means being a resistance device having a substantially linear change in resistance in response to ambient temperature change.

6. A controller as claimed in claim 5, said resistive device being a linear RTD.

7. A controller as claimed in claim 1, including a second heater in said second probe adapted to be connected to said power generation means.

8. A controller as claimed in claim 7, including switching means for selectively connecting either said first or second heater to said power generation means.

9. A controller as claimed in claim 5, including a second constant current power source adapted for connection to said resistive devices.

10. A controller as claimed in claim 9, said control means including an analog-to-digital converter for converting said signals generated by said resistive devices to a digital signal.

11. A controller as claimed in claim 1, said control means including a processor means, said processor means comprising:

a) means for storing an established flow time, shut-in time, a time-out period and a low-flow point;

b) means for determining a temperature difference between said first and second temperature sensing means said temperature difference being indicative of a flow rate in said well;

c) means for storing said flowrate;

d) means for comparing said flowrate with said low-flowpoint and for updating the timing-out period if said flowrate is greater than said low-flow point; and e) means for generating said output signal to turn said pump unit off when said timing out period has expired and for turning on said pumping unit when said shut-in period has expired.

12. A controller as claimed in claim 11, including means for determining a rolling average of said flowrates.

13. A controller including a processor, said processor comprising:

a) means for determining a temperature difference between first and second temperature sensors said temperature difference being indicative of a flow rate in a well;

b) means for generating an output signal being indicative of a pump speed;

c) means for storing a table of flowrates versus said pump speeds;

d) means for determining a rolling average of said flowrates;

e) means for comparing said current rolling flow average to a stored flowrate and either incrementing said pump speed if said stored flowrate exceeds said average, or decrementing said pump speed if said flowrate is less than said average; and f) means for updating said table.

14. A method for controlling a variable speed pump comprising the steps of:

a. determining a pump speed;

b. measuring a pump flow;

c. incrementing said pump speed;

d. measuring a current flow at said incremented pump speed; and e. comparing said current flow to said previously measured flow and either:

i. decrementing said pump speed to a speed corresponding to a flow prior to the step of incrementing said pump speed, if said current flow is equal to or less than said measured flow; or ii. incrementing said pump speed if said current flow is greater than said measured flow; ;and f. repeating at said step e.

15. A method as defined in claim 14, including the step of compiling a table of said measured flows versus corresponding pump speeds.

16. A method as defined in claim 15, in including computing a rolling average of said compiled flows, and thereafter using said rolling average flow as said current flow in said comparing step.

17. A method as defined in claim 14, said flow being determined by a thermal dispersion sensor.

18. A System for controlling a plurality of variable speed pumps, said system comprising:

a. a network interface coupled to a processor to receive flow signals and pump speeds from each of a plurality of wells; and b. said processor:

i) storing a table of flow versus said pump speeds for each of said wells;

ii) determining a rolling average of said flows for each of said wells;

iii) for each of said wells comparing said current rolling flow average to a stored flow and generating a signal for; either incrementing said pump speed of said well if said stored flow exceeds said average, or decrementing said pump speed of said well if said flow is less than said average; and iv) updating said table for each of said wells.

* * * * *